US007012222B2

(12) United States Patent
Choo

(10) Patent No.: US 7,012,222 B2
(45) Date of Patent: Mar. 14, 2006

(54) METHOD AND APPARATUS FOR CONTROLLING A HEAT SOURCE

(75) Inventor: Jong-yang Choo, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/885,111

(22) Filed: Jul. 7, 2004

(65) Prior Publication Data

US 2005/0023272 A1 Feb. 3, 2005

(30) Foreign Application Priority Data

Jul. 28, 2003 (KR) ..... 10-2003-0052081

(51) Int. Cl.
*H05B 1/02* (2006.01)
*H05B 6/14* (2006.01)

(52) U.S. Cl. ..... 219/492; 219/619; 399/67; 399/69

(58) Field of Classification Search ..... 219/619, 219/216, 469, 494, 492, 497, 501, 543, 626, 219/664, 668, 667, 687; 399/328–333, 326, 399/69, 67, 70, 78, 88–89; 323/235, 319
See application file for complete search history.

(56) References Cited

U.S. PATENT DOCUMENTS 5,669,038 A * 9/1997 Kishimoto ..... 399/67
6,301,454 B1 * 10/2001 Nishida et al. ..... 399/69

FOREIGN PATENT DOCUMENTS

| | | |
|---|---|---|
| JP | 9-80961 | 3/1997 |
| JP | 2000-330653 | 11/2000 |
| KR | 1998-72500 | 11/1998 |
| KR | 2000-40693 | 7/2000 |

* cited by examiner

*Primary Examiner*—Quang Van
(74) *Attorney, Agent, or Firm*—Staas & Halsey LLP

(57) ABSTRACT

An apparatus and method of controlling the driving of a heat source using an AC voltage. If the temperature of the heat source is lower than a reference temperature and the level of the AC voltage is greater than a reference level, the level of a sensing signal is changed. Then, it is determined whether a predetermined period of time has lapsed from the moment when the level of the sensing signal has been changed. Thereafter, if it is determined that the predetermined period of time has lapsed from the moment when the level of the sensing signal has been changed, the heat source is driven when the level of the AC voltage is a zero level. Accordingly, if the frequency of a received AC voltage is not fixed to a specific frequency, but varies, or if the driving control signal is delayed and generated while the AC voltage has a constant frequency, the driving control signal is generated after the lapse of a predetermined period of time after the level of a sensing signal is transited from a high logic level to a low logic level. Thus, an AC voltage is supplied to a heat source at a regular duty cycle, thereby stably controlling the heat source and preventing occurrence of flickering.

8 Claims, 8 Drawing Sheets

METHOD AND APPARATUS FOR CONTROLLING A HEAT SOURCE

CROSS-REFERENCE TO RELATED APPLICATIONS

This application claims the priority benefit of Korean Patent Application No. 2003-52081, filed on Jul. 28, 2003, in the Korean Intellectual Property Office, the disclosure of which is incorporated herein in its entirety by reference.

BACKGROUND OF THE INVENTION

1. Field of the Invention

The present invention relates to a heat source, such as a heat source, e.g., a heater lamp, included in an image forming apparatus, such as an image forming apparatus, and more particularly, to a method and apparatus for controlling the heat source.

2. Description of the Related Art

A conventional fusing circuit for driving a heat source included in an image forming apparatus, e.g., a image forming apparatus, is set forth in Korean Patent Application No. 2003-31680, entitled "Apparatus and method of controlling a heat source, in which a received alternating current (AC) voltage is sensed and a pulse signal corresponding to the sensed AC voltage is provided", filed on May 19, 2003, with a corresponding U.S. application being filed on Feb. 20, 2004, having a Ser. No. of 10/781,655.

In this disclosed conventional fusing circuit, if a light emitting diode PTa2 emits light in response to a heat source control signal, supplied by a controller, a corresponding phototriac PTa1 turns on a triac Ta1 when the level of a corresponding alternating current (AC) voltage is zero, so that the AC voltage is applied to the heat source. However, if the light emitting diode PTa2 does not emit light, in response to the heat source control signal, the phototriac PTa1 turns off the triac Ta1 when the level of the AC voltage is zero, resulting in no AC voltage being applied to the heat source.

The above conventional heat source controlling method will now be described in more detail, with reference to FIGS. 1A through 4D.

FIGS. 1A–1D illustrate waveforms in the heat source controlling apparatus, including the conventional fusing circuit, disclosed in the aforementioned conventional heat source controlling method, if the frequency of the AC voltage is 50 Hz. In FIGS. 1A–1D, FIG. 1A illustrates a waveform of an AC voltage, FIG. 1B illustrates a waveform of a driving control signal which the controller applies to the light emitting diode PTa2, FIG. 1C illustrates a waveform of a gate signal which is applied to a gate of the triac Ta1, and FIG. 1D illustrates a waveform of an AC voltage that is supplied to the heat source.

FIGS. 2A–2D illustrate waveforms in the heat source controlling apparatus disclosed in the aforementioned conventional heat source controlling method, if the frequency (e.g., 50 Hz) of the AC voltage has a frequency deviation (Δf), e.g., a frequency deviation of −3 Hz. In FIGS. 2A–2D, FIG. 2A illustrates a waveform of an AC voltage, FIG. 2B illustrates a waveform of the driving control signal, FIG. 2C illustrates a waveform of the gate signal, and FIG. 2D illustrates a waveform of an AC voltage supplied to the heat source.

It is assumed that the frequency of the AC voltage of FIG. 1A may be reduced in frequency, as illustrated in FIG. 2A because of the frequency deviation. The driving control signal can be a logic high level at intervals of 10 ms, as shown in FIG. 2B, and 50% of the AC voltage may be supplied to the heat source in a wave number control manner. Since the period of the driving control signal of FIG. 2B is different from that of the AC voltage of FIG. 2A, a gate signal with the waveform of FIG. 2C is generated instead of the gate signal with the waveform of FIG. 1C. Hence, the heat source may receive an inaccurate voltage, as illustrated in FIG. 2D, which may not have exactly a 50% duty cycle, instead of the voltage having exactly a 50% duty cycle, as illustrated in FIG. 1D.

FIGS. 3A–3D illustrate waveforms in the heat source controlling apparatus disclosed in the aforementioned conventional heat source controlling method, if the frequency (e.g., 50 Hz) of the AC voltage has a frequency deviation (Δf), e.g., a frequency deviation of +3 Hz. In FIGS. 3A–3D, FIG. 3A illustrates a waveform of an AC voltage, FIG. 3B illustrates a waveform of the driving control signal, FIG. 3C illustrates a waveform of the gate signal, and FIG. 3D illustrates a waveform of an AC voltage supplied to the heat source.

Similar to the above, it is assumed that the frequency of the AC voltage of FIG. 1A may increase in frequency, as illustrated in FIG. 3A, due to a frequency deviation. The driving control signal can have a logic high level at intervals of 10 ms, as shown in FIG. 3B, and 50% of the AC voltage can be supplied to the heat source in a wave number control manner. Since the period of the driving control signal of FIG. 3B is different from that of the AC voltage of FIG. 3A, a gate signal with the waveform of FIG. 3C is generated, instead of the gate signal with the waveform of FIG. 1C. Hence, the heat source may receive an inaccurate voltage, as illustrated in FIG. 3D, which does not have exactly the 50% duty cycle, instead of the voltage having exactly the 50% duty cycle as illustrated in FIG. 1D.

FIGS. 4A–4D illustrate waveforms in the heat source controlling apparatus disclosed in the aforementioned conventional heat source controlling method, in the event that the driving control signal is delayed and generated by the controller and received by the fusing circuit. In FIGS. 4A–4D, FIG. 4A illustrates a waveform of an AC voltage, FIG. 4B illustrates a waveform of the driving control signal, FIG. 4C illustrates a waveform of the gate signal, and FIG. 4D illustrates a waveform of an AC voltage supplied to the heat source.

In this case, it will be assumed that the frequency of the AC voltage of FIGS. 4A–4D is kept at 50 Hz, as illustrated in FIG. 1A. A driving control signal having a changed duty, illustrated in FIG. 4B, is generated by the controller and applied to the fusing circuit, and 50% of the AC voltage is then supplied to the heat source in a wave number control way. Since the driving control signal, having a changed duty cycle as illustrated in FIG. 4B, is generated instead of the driving control signal of FIG. 1B, that is, since the generated driving control signal is delayed, the heat source may receive an inaccurate voltage as illustrated in FIG. 4D, which does not have exactly the 50% duty cycle, instead of the voltage having exactly the 50% duty cycle, as illustrated in FIG. 1D. This occurs because the controller processes a command having higher priority over the driving control signal, i.e., the controller delays the driving control signal and then supplies the delayed driving control signal to the fusing circuit.

Depending on the countries where the image forming apparatus is used, the level of an AC voltage applied to the image forming apparatus may be 110V or 220V, and the frequency thereof may be 50 Hz or 60 Hz. Hence, in the conventional heat source controlling method, if the frequency of the AC voltage is not fixed, that is, if it varies, or if the driving control signal is delayed and generated by the controller while the AC voltage has a constant frequency, the heat source cannot operate properly, e.g., flickering may occur.

SUMMARY OF THE INVENTION

Accordingly, it is an aspect and/or advantage of the present invention to solve the above and/or other problems. Embodiments of present invention provide a heat source controlling method which can prevent an undesired influence upon the driving of a heat source due to a change in the frequency of an AC voltage driving the heat source, or due to a delay of the generation of a driving control signal controlling the supply of the AC voltage to the heat source.

Embodiments of present invention also provide a heat source controlling apparatus which can prevent an undesired influence upon the driving of a heat source due to the change in the frequency of an AC voltage driving the heat source, or due to a delay of the generation of a driving control signal controlling the supply of the AC voltage to the heat source.

Additional aspects and/or advantages of the invention will be set forth in part in the description which follows and, in part, will be obvious from the description, or may be learned by practice of the invention.

To achieve the above and/or additional aspects and advantages, embodiments of the present invention include a method of controlling the driving of a heat source using an AC voltage, the method including changing a level of a sensing signal if a temperature of the heat source is lower than a reference temperature and a level of an input AC voltage is greater than a reference level, determining whether a predetermined period of time has lapsed from a moment when the sensing signal has been changed, and driving the heat source when the AC voltage is in a zero level, if it is determined that the predetermined period of time has lapsed from a moment when the sensing signal level has been changed.

In addition, the changing of the level of the sensing signal may include measuring the level of the input AC voltage and the temperature of the heat source, determining whether the measured temperature of the heat source is lower than the reference temperature, determining whether the measured level of the input AC voltage is greater than the reference level, if it is determined that the measured temperature of the heat source is lower than the reference temperature, and changing the level of the sensing signal if it is determined that the measured level of the AC voltage is greater than the reference level.

The predetermined period of time may be based on at least one of the reference level, a variation range of the input AC voltage, and a delay duration, with the delay duration being a time during which generation of a driving control signal is delayed until the driving the heat source is performed, after it is determined whether the predetermined period of time has lapsed from the moment when the sensing signal level had been changed.

To achieve the above and/or still additional aspects and advantages, embodiments of the present invention include an apparatus for controlling the driving of a heat source, the apparatus including a sensing signal generator to change a level of a sensing signal and output the sensing signal with the changed level if a temperature of the heat source is lower than a reference temperature and a level of an input AC voltage is greater than a reference level, a timer to determine whether a predetermined period of time has lapsed from a moment when the sensing signal level has been changed, and output a driving control signal generated in response to a result of the timer determination, and a heat source driver to drive the heat source when the level of the input AC voltage is a zero crossing level, in response to the driving control signal.

Again, the sensing signal generator may include a level measurer to measure the level of the AC voltage, a temperature sensor to measure the temperature of the heat source, a temperature comparator to compare the measured temperature of the heat source with the reference temperature and output the result of the comparison as a first control signal, a voltage comparator to compare the measured level of the AC voltage with the reference level in response to the first control signal and output the result of the comparison as a second control signal, and a level changer to change the level of the sensing signal and output the sensing signal with the changed level, in response to the second control signal.

The heat source driver may include a switch to transmit the input AC voltage to the heat source in response to a gate signal, and a gate signal generator to determine a level of the gate signal based on a level of the driving control signal every time the level of the input AC voltage is a zero crossing level, and to output a gate signal with the determined level to the switch, wherein the heat source is driven by the input AC voltage received via the switch.

Lastly, to achieve at least the above and/or additional aspects and advantages, embodiments of the present invention include a image forming apparatus, having a fusing roller for fusing toner and a heat source for heating the fusing roller, the image forming apparatus including a sensing signal generator to change a level of a sensing signal and output the sensing signal with the changed level if a temperature of the heat source is lower than a reference temperature and a level of an input AC voltage is greater than a reference level, a timer to determine whether a predetermined period of time has lapsed from a moment when the sensing signal level has been changed, and output a driving control signal generated in response to a result of the timer determination, and a heat source driver to drive the heat source when the level of the input AC voltage is a zero crossing level, in response to the driving control signal.

The heat source driver may include a switch to transmit the input AC voltage to the heat source in response to a gate signal, and a gate signal generator to determine a level of the gate signal based on a level of the driving control signal every time the level of the input AC voltage is a zero crossing level, and to output a gate signal with the determined level to the switch, wherein the heat source is driven by the input AC voltage received via the switch.

Further, the switch may include a gate connected the gate signal and a triac, with the gate signal generator including a phototriac, including a light emitting diode and a light receiving diode, such that the light emitting diode receives a predetermined voltage and emits light based on a level of the driving control signal and the light receiving diode receives light emitted from the light emitting diode and generates the gate signal based on the received light.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figures 1A, 1B, 1C, 1D:
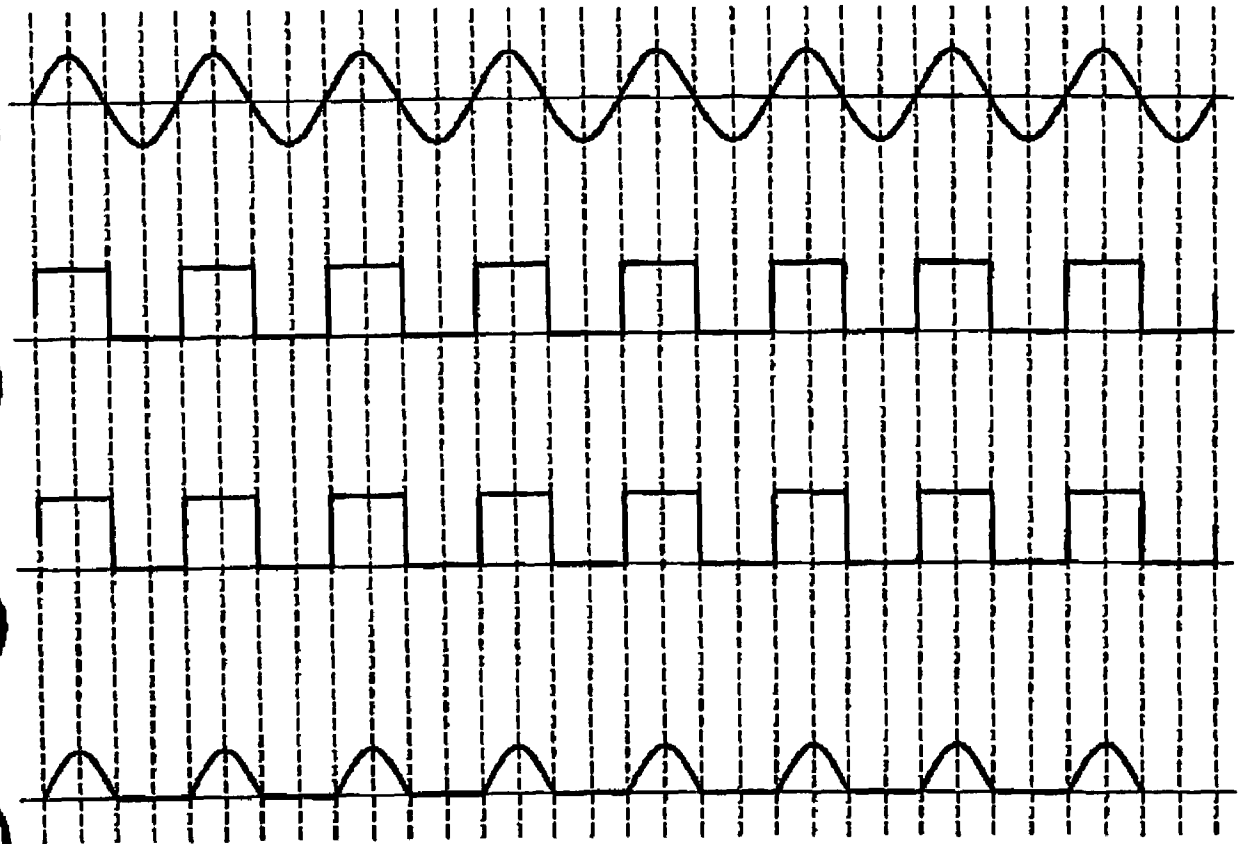
FIG. 1A (PRIOR ART)
FIG. 1B (PRIOR ART)
FIG. 1C (PRIOR ART)
FIG. 1D (PRIOR ART)
FIGS. 1A–1D illustrate waveforms in a conventional heat source controlling apparatus if the frequency of an AC voltage is 50 Hz.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 5:
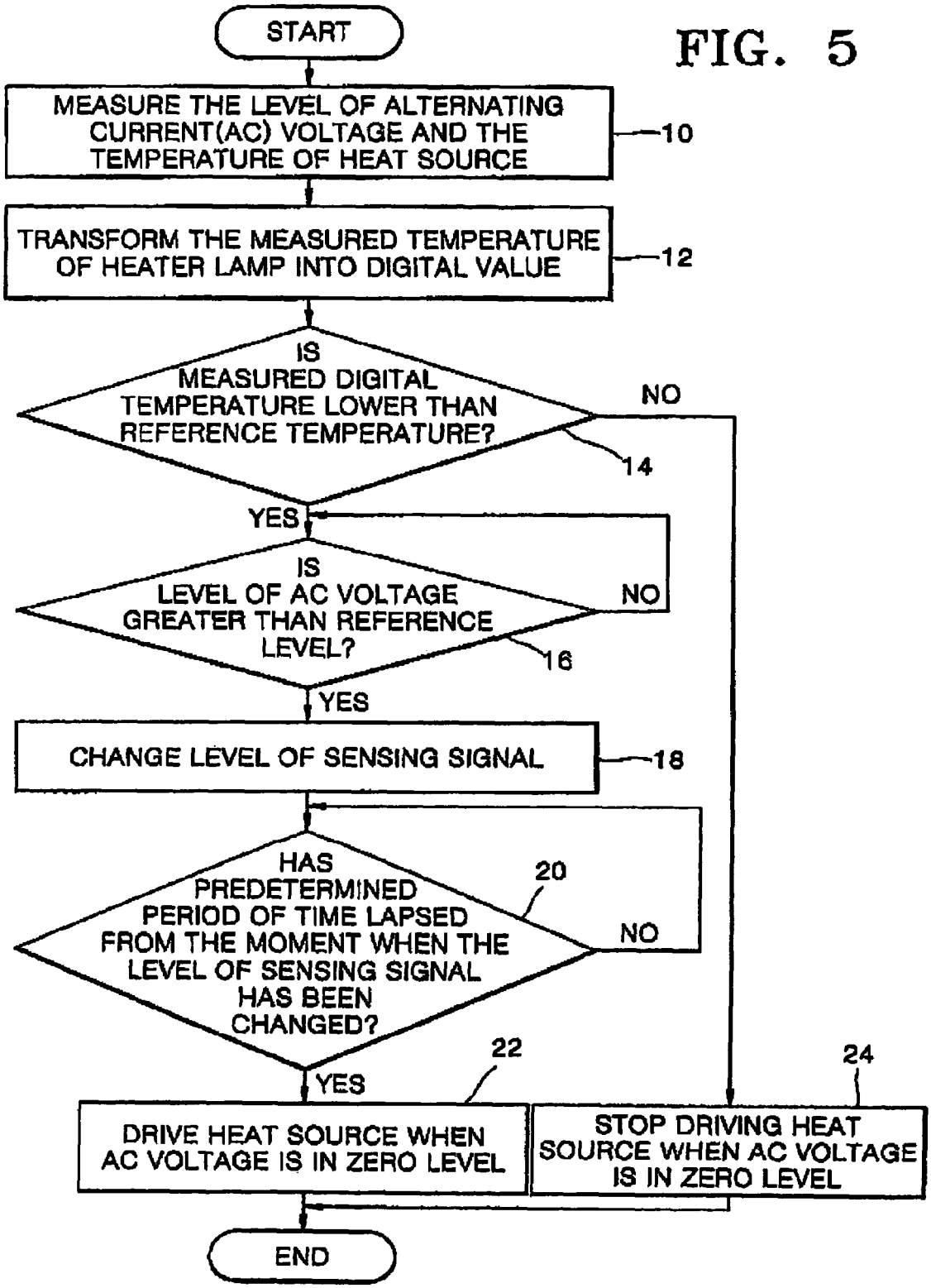
FIG. 5 is a flowchart illustrating a heat source controlling method, according an embodiment of the present invention.

Referring to FIG. 5, FIG. 5 illustrates a heat source controlling method according to an embodiment of the present invention, and includes operations 10 through 18 for changing a level of a sensing signal and operations 20 through 24 for controlling the operation of a heat source.

According to the heat source controlling method, of FIG. 5, the operation of the heat source (not shown) is controlled using an AC voltage. First, in operations 10 through 18, if the temperature of the heat source is lower than a reference temperature and the level of the AC is greater than a reference level, the level of a sensing signal is changed.

If an image processing apparatus is a image forming apparatus, the temperature of the heat source can denote the surface temperature of a fusing roller (not shown). The heat source may be installed at a predetermined location where the heat source can heat the fusing roller, for example, within the fusing roller. The reference temperature level can be a temperature at which the fusing roller can fuse a toner.

The reference level is set based on a variation range of the level of an input AC voltage. For example, the reference level can be set to be half of the minimum level of the AC voltage. In other words, if the variation in level of the AC voltage is between 90V and 132V, the reference level can be set to be 45V. If the variation in level of the AC voltage is between 180V and 264V, the reference level can be set to be 90V. The sensing signal may be a pulse reference signal, similar to that used in the aforementioned conventional heat source.

More specifically, in operation 10, the level of the AC voltage and the temperature of the heat source are measured.

According to an embodiment of the present invention, operation 10 is followed by a converting of the measured temperature of the heat source into a digital temperature, in operation 12. Operation 12 is then followed by a determining of whether the digital temperature of the heat source is lower than a digital reference temperature, in operation 14.

According to another embodiment of the present invention, operation 12 may not be included in the heat source controlling method. In which case, operation 10 is followed by the determining of whether the measured temperature of the heat source is lower than a reference temperature, in operation 14.

If it is determined in operation 14 that the measured temperature of the heat source is lower than the reference temperature, it is then determined in operation 16 whether the measured level of the AC voltage is greater than a reference level. If it is determined in operation 16 that the measured level of the AC voltage is not greater than the reference level, the process returns to operation 16. However, if it is determined in operation 16 that the measured level of the AC voltage is greater than the reference level, then the level of a sensing signal is changed, in operation 18, for example, the level of the sensing signal may be transited from a low logic level to a high logic level.

If it is determined in operation 14 that the measured temperature of the heat source is not lower than the reference temperature, the driving of the heat source is then stopped when the level of the AC voltage is zero, in operation 24. In other words, if the measured temperature of the heat source is not lower than the reference temperature, no AC voltage is applied to the heat source.

After operation 18, it is determined whether a predetermined period of time has lapsed from the point in time when the level of the sensing signal has changed, in operation 20. If it is determined in operation 20 that a predetermined period of time has not lapsed, from the point in time when the level of the sensing signal has changed, operation 20 is then repeated. However, if it is determined in operation 20 that a predetermined period of time has lapsed, from the point in time when the level of the sensing signal has changed, the heat source is then driven when the level of the AC voltage is zero, in operation 22. In other words, in this case, when the level of the AC voltage is zero, the AC voltage will be applied to the heat source.

The predetermined period of time is determined based on at least one of the reference level of an AC voltage, the frequency variation range of the AC voltage, and the duration of delay of the AC voltage. For example, the predetermined period of time can be set in inverse proportion to the reference level, in proportion to the frequency variation width of an AC voltage, or in proportion to a time during which the AC voltage is delayed. The delay duration corresponds to the duration after it is determined, in operation 20, that a predetermined period of time has lapsed from the point in time when the level of the sensing signal has been changed, before operation 22 is executed. More specifically, if operation 20 is executed in a central processing unit (not shown), which controls the entire system of an image forming apparatus that performs a heat source controlling method of an embodiment of the present invention, the central processing unit will generate a driving control signal controlling operation 22 to be performed, when it is determined that a predetermined period of time has lapsed from the moment when the level of the sensing signal has been changed. The central processing unit does not only process the driving control signal but also processes commands that control other systems (not shown) in the image forming apparatus. In addition, if the central processing unit is processing a command having a higher priority over the driving control signal, at the moment when the driving control signal is to be generated, the central processing unit may have no choice but to delay the driving control signal for the delay duration and to generate the delayed driving control signal.

Figures 2A, 2B, 2C, 2D:
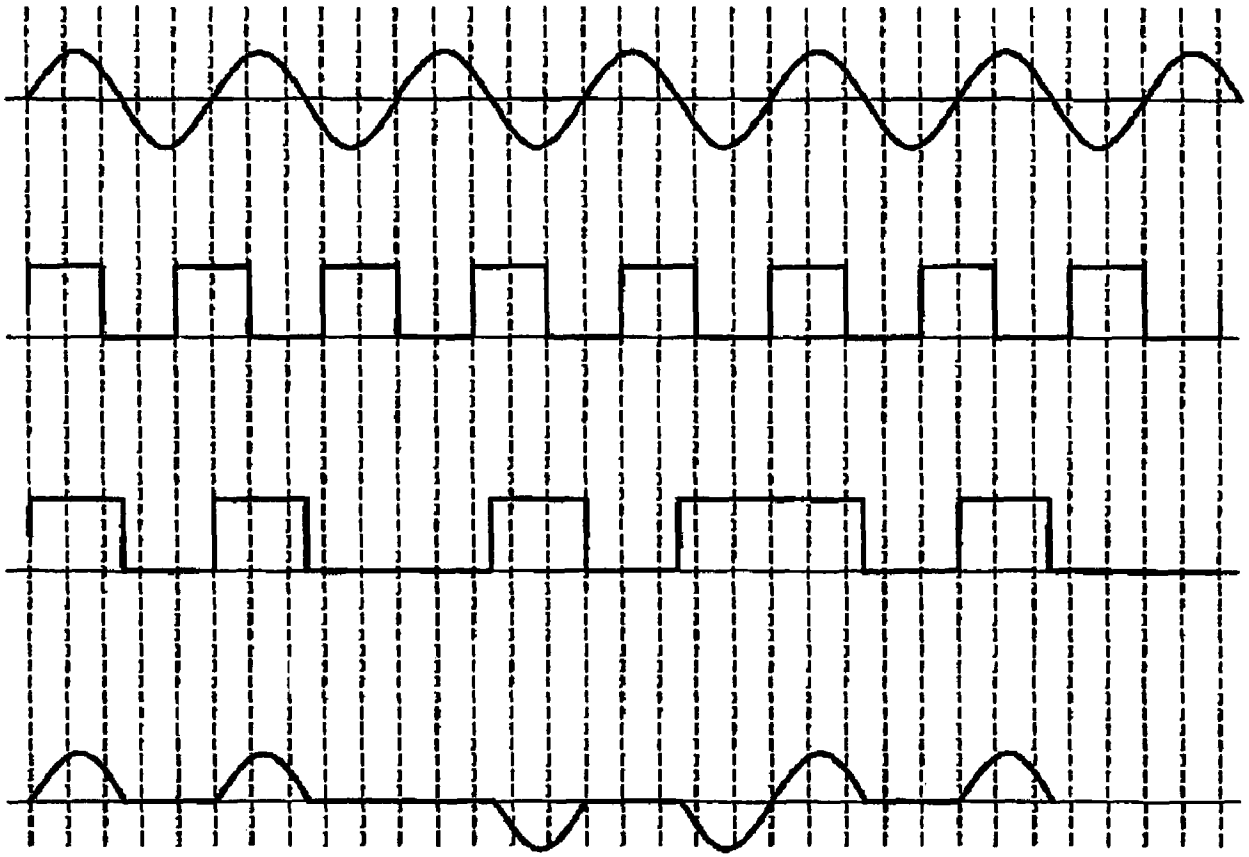
FIG. 2A (PRIOR ART)
FIG. 2B (PRIOR ART)
FIG. 2C (PRIOR ART)
FIG. 2D (PRIOR ART)
FIGS. 2A–2D illustrate waveforms in the conventional heat source controlling apparatus, if the frequency of an AC voltage is 47 Hz.
Figures 3A, 3B, 3C, 3D:
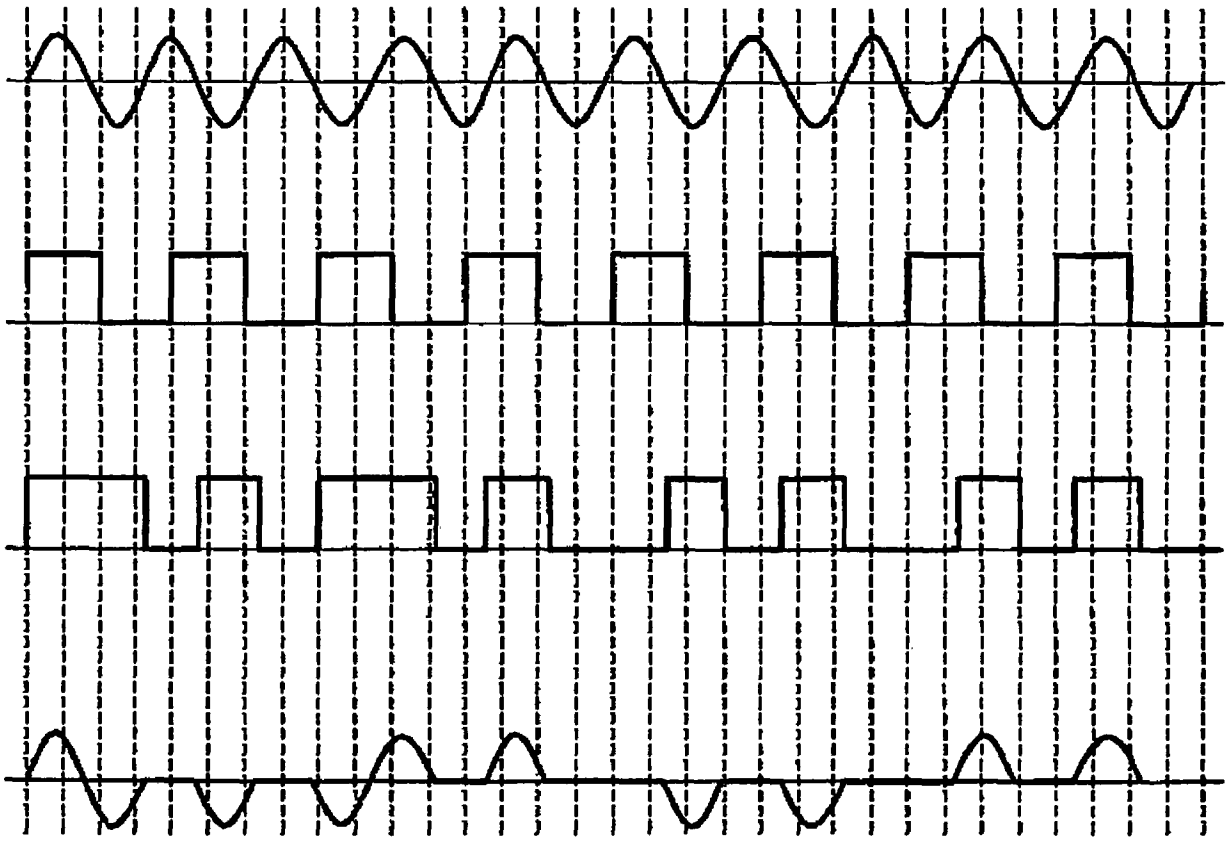
FIG. 3A (PRIOR ART)
FIG. 3B (PRIOR ART)
FIG. 3C (PRIOR ART)
FIG. 3D (PRIOR ART)
FIGS. 3A–3D illustrate waveforms in the conventional heat source controlling apparatus, if the frequency of an AC voltage is 53 Hz.

As noted above, if an AC voltage with a constant frequency, as illustrated in FIG. 1A, is not applied to the heat source, but rather an AC voltage with a changed frequency, as illustrated in FIG. 2A or FIG. 3A is applied, supply of the AC voltage according to a conventional heat source controlling method becomes irregular and inaccurate, as further illustrated in FIG. 2D or 3D. However, in a heat source controlling method, according to embodiments of the present invention, after a predetermined period of time has lapsed from the moment when the level of the sensing signal is transited from a low logic level to a high logic level, for example, the heat source is driven when the level of the AC voltage becomes zero. Hence, although the frequency of the AC voltage is fluctuating, the AC voltage can still be provided to the heat source at a regular duty cycle, as illustrated in FIG. 1D. In this case, the predetermined period of time can be based on the frequency variation range of the AC voltage.

Figures 4A, 4B, 4C, 4D:
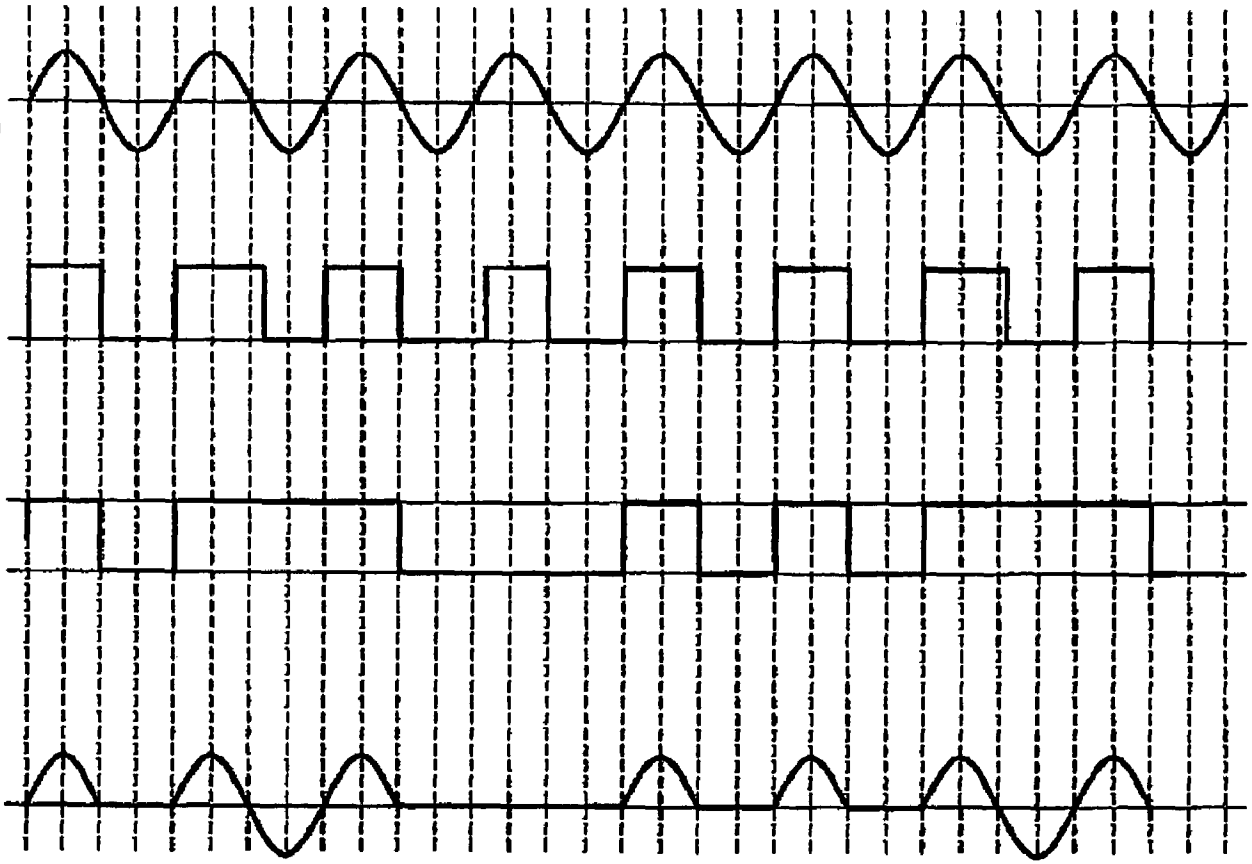
FIG. 4A (PRIOR ART)
FIG. 4B (PRIOR ART)
FIG. 4C (PRIOR ART)
FIG. 4D (PRIOR ART)
FIGS. 4A–4D illustrate waveforms in the conventional heat source controlling apparatus, in the event that a driving control signal is delayed, as generated by a controller and received by a fusing circuit portion.

If an AC voltage with a frequency constant, as illustrated in FIG. 1A, is applied to a heat source, but generation of a driving control signal instructing execution of operation 22 is delayed, as illustrated in FIG. 4B, supply of the AC voltage according to the conventional heat source controlling method also becomes irregular and inaccurate, as illustrated in FIG. 4D. However, in a heat source controlling method, according to an embodiment of the present invention, after a predetermined period of time has lapsed from a moment when the level of a sensing signal has been transited from a low logic level to a high logic level, for example, the heat source is then driven when the level of the AC voltage becomes zero. Hence, although a delayed driving control signal is generated, the AC voltage can be provided to the heat source at a regular duty cycle, similar to that illustrated in FIG. 1D. In this case, the predetermined period of time can be set based on the delay duration.

In the aforementioned conventional heat source controlling method, the driving of the heat source is controlled using a heat source control pulse signal. However, in a heat source controlling method, according to an embodiment of the present invention, the driving of the heat source can be controlled by directly using a sensing signal corresponding to a pulse reference signal.

Figure 6:
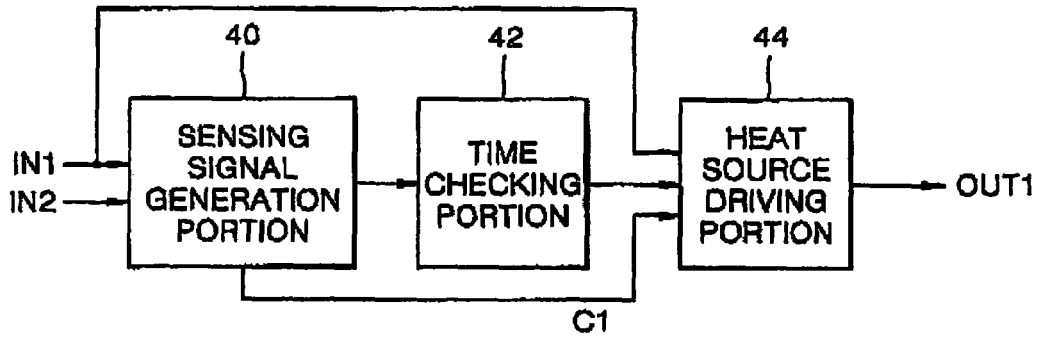
FIG. 6 is a block diagram of a heat source controlling apparatus, according to an embodiment of the present invention.

The structure and operation of a heat source controlling apparatus, according to embodiments of the present invention, will now be described with FIGS. 6 through 9. FIG. 6 is a block diagram of a heat source controlling apparatus, according to an embodiment of the present invention. This heat source controlling apparatus includes a sensing signal generator 40, a timer 42, and a heat source driver 44.

The heat source controlling apparatus of FIG. 6 may execute the heat source controlling method of FIG. 5. To perform operations 10 through 18, if a heat source temperature, received via an input port IN1, is lower than a reference temperature, and an AC voltage level, received via an input port IN2, is greater than a reference level, the sensing signal generator 40 can change the level of a sensing signal and output the sensing signal with the changed level, to the timer 42.

Figure 7:
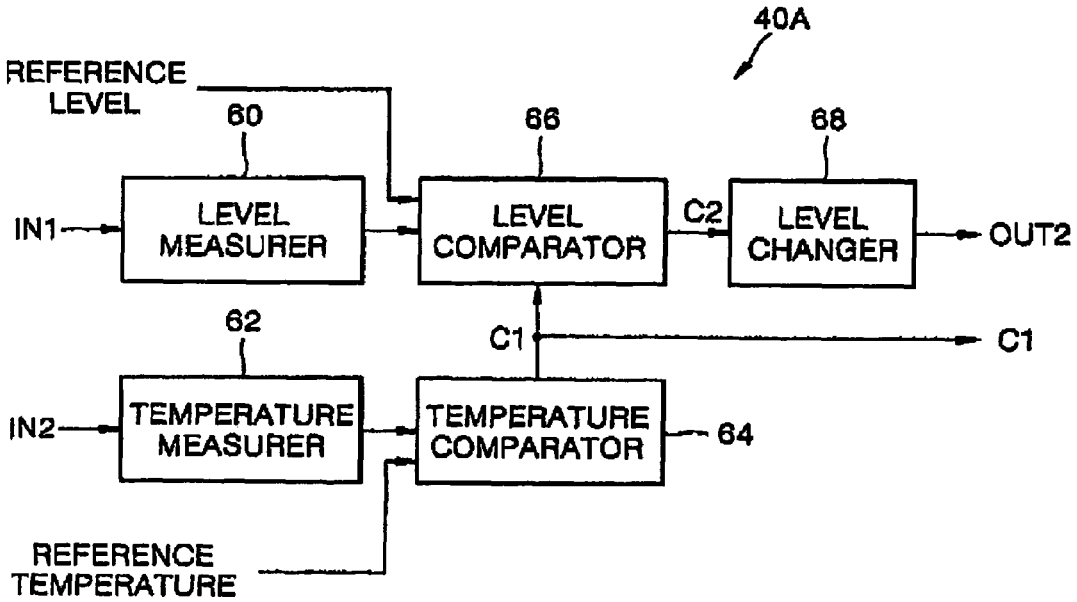
FIG. 7 is a block diagram of an embodiment of a sensing signal generator of the embodiment of the present invention illustrated in FIG. 6.

FIG. 7 is a block diagram of a sensing signal generator 40A, according to an embodiment of the sensing signal generator 40, of FIG. 6. The sensing signal generator 40A includes a level measurer 60, a temperature sensor 62, a temperature comparator 64, a voltage comparator 66, and a level changer 68.

In this embodiment, the sensing signal generator 40A executes operations 10, 14, 16, and 18 of FIG. 5. For example, the level measurer 60 and the temperature sensor 62 can execute operation 10. The level measurer 60 measures the level of an AC voltage received, via an input port IN1, and outputs the measured AC voltage level to the voltage comparator 66. At this time, the temperature sensor 62 measures a heat source temperature, received via an input port IN2, and outputs the measured heat source temperature to the temperature comparator 64.

To execute operation 14, the temperature comparator 64 compares the measured heat source temperature, received from the temperature sensor 62, with a reference temperature, and outputs the result of the comparison as a first control signal C1 to the voltage comparator 66.

To execute operation 16, the voltage comparator 66 compares the AC voltage level, measured by the level measurer 60, with a reference level in response to the first control signal C1, received from the temperature comparator 64, and outputs the result of the comparison as a second control signal C2 to the level changer 68. If the voltage comparator 66 recognizes, from the first control signal C1, that the measured heat source temperature is lower than the reference temperature, the voltage comparator 66 compares the measured AC voltage level with the reference level.

To execute operation 18, the level changer 68 changes the level of the sensing signal, in response to the second control signal C2 received from the voltage comparator 66, and outputs the sensing signal with the changed level to the timer 42, via an output port OUT2. If the level changer 68 recognizes, from the second control signal C2, that the measured AC voltage level is greater than the reference level, the level changer 68 changes the level of the sensing signal.

Figure 8:
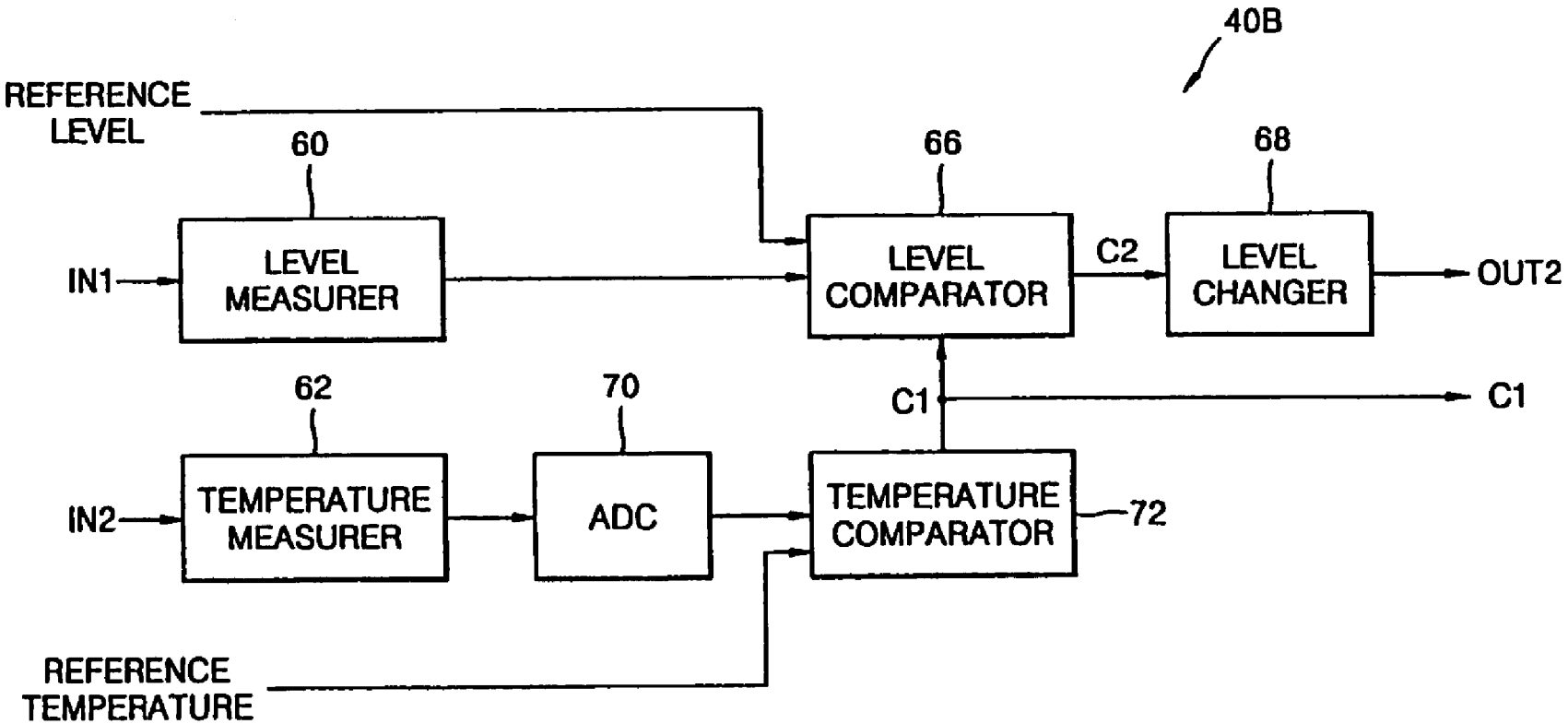
FIG. 8 is a block diagram of another embodiment of the sensing signal generator of the embodiment of the present invention illustrated in FIG. 6.

FIG. 8 is a block diagram of a sensing signal generator 40B, which is another embodiment of the sensing signal generator 40, of FIG. 6. The sensing signal generator 40B includes a level measurer 60, a temperature sensor 62, an analog-to-digital converter (ADC) 70, a temperature comparator 72, a voltage comparator 66, and a level changer 68.

In this embodiment, the sensing signal generator 40B can execute operations 10, 12, 14, 16, and 18 of FIG. 5. Since the level measurer 60, the temperature sensor 62, the comparator 66, and the voltage changer 68, of FIG. 8, play corresponding roles as similar elements in FIG. 7, the description thereof will not be repeated.

The ADC 70 executes operation 12 by converting the heat source temperature, measured by the temperature sensor 62, into a digital value and outputting the digital heat source temperature to the temperature comparator 72. To perform operation 14, the temperature comparator 72 compares the digital heat source temperature, received from the ADC 70, with a digital reference temperature and outputs the result of the comparison to the voltage comparator 66.

To perform operation 20, the timer 42, of FIG. 6, checks whether a predetermined period of time has lapsed from the moment when the level of the sensing signal, received from the sensing signal generator 40, has changed, generates a driving control signal in response to the result of the time check, and outputs the driving control signal to the heat source driver 44.

The heat source driver 44, of FIG. 6, executes operations 22 and 24 of FIG. 5. To perform operation 22, the heat source driver 44 drives the heat source when the level of the AC voltage is zero, in response to receipt of the driving control signal from the timer 42. For example, it is assumed that a driving control signal, in a high logic level, is generated by the timer 42 when the predetermined period of time has lapsed, from the moment when the level of the sensing signal is changed. In this case, if the heat source driver 44 receives the driving control signal, in a high logic level, from the timer 42, the heat source driver 44 applies an AC voltage for driving a heat source to the heat source, via an output port OUT1, when the AC voltage received via the input port IN1 is in a zero level. If the heat source driver 44 receives the driving control signal, in a low logic level, from the timer 42, the heat source driver 44 stops applying the AC voltage to the heat source when the AC voltage, received via the input port IN1, is in a zero level.

To perform operation 24, the heat source driver 44 stops the driving of the heat source when the AC voltage is in a zero level, in response to the first control signal C1, received from the sensing signal generator 40. The first control signal C1 is generated by the temperature comparator 64 or 72, of FIG. 7 or 8, respectively. In other words, when the heat source driver 44 recognizes, from the first control signal C1, that the measured heat source temperature is not lower than the reference temperature, the heat source driver 44 does not apply the AC voltage for driving a heat source to the heat source.

If operation 20 of FIG. 5 is executed, in the central processing unit, the timer 42, of FIG. 6, can be included in the central processing unit. In this case, the delay duration, which is a basis for the predetermined period of time, can be the time during which receipt of the driving control signal, by the heat source driver 44, is delayed, heat source driving portion 44] after the timer 42 checks the lapse of the predetermined period of time. As described above, the central processing unit can process various commands. The central processing unit generates the driving control signal, based on the result of the time check made by the timer 42, delays the driving control signal until a command having a higher priority over the driving control signal is completely processed, and transmits the delayed driving control signal to the heat source driver 44. Thus, a delay duration can be induced.

Figure 9:
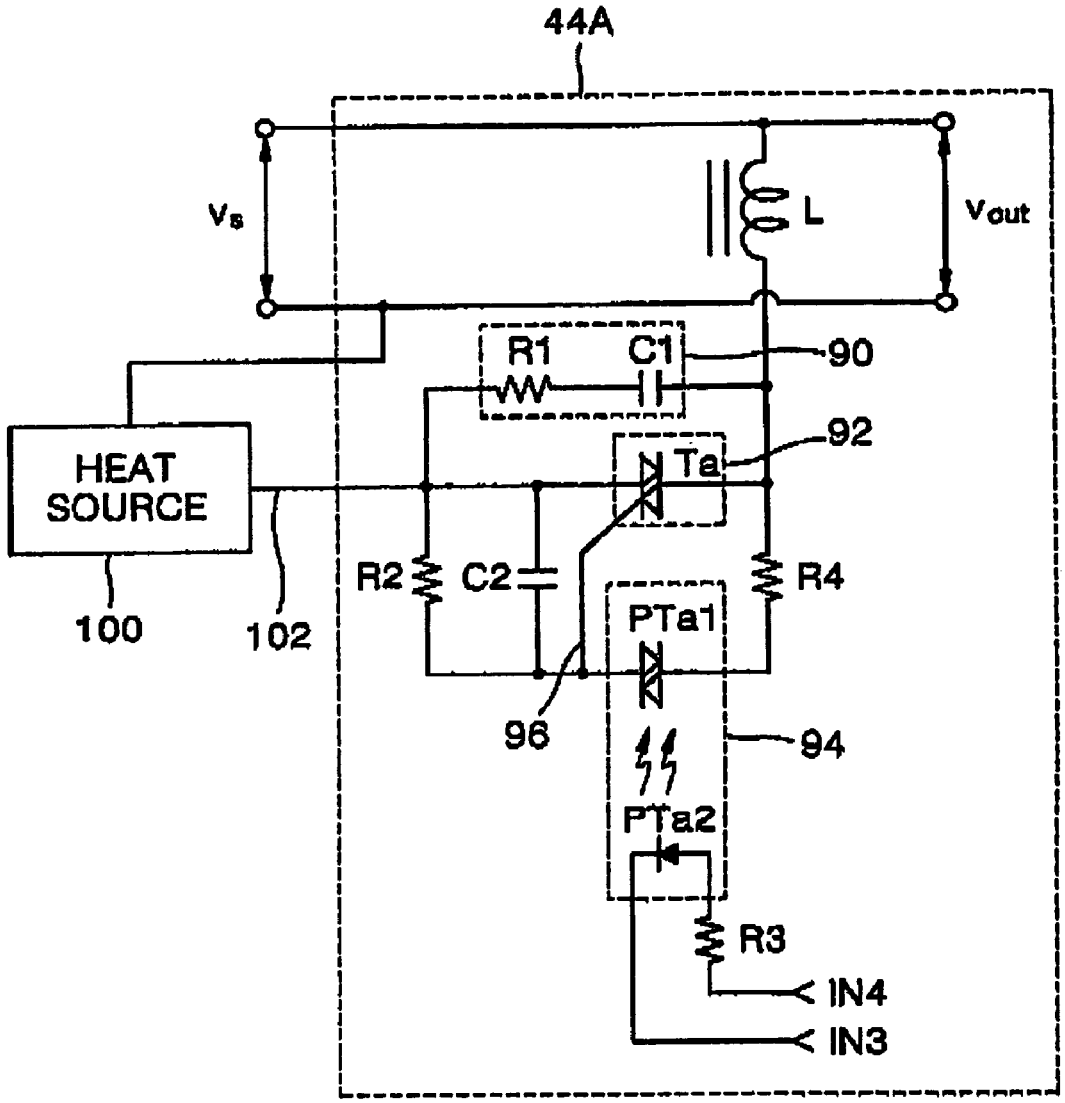
FIG. 9 is a circuit diagram of a heat source driving of the embodiment of the present invention illustrated in FIG. 6.

FIG. 9 illustrates a circuit diagram explaining a heat source driver 44A, which is an embodiment of the heat source driver 44, of FIG. 6. FIG. 9 illustrates a heat source 100 and the heat source driver 44A.

The heat source driver 44A includes a snubber 90, a switch 92, a gate signal generator 94, an inductor L, resistors R2, R3, and R4, and a capacitor C2.

The heat source driver 44A may be made up of only the switch 92 and the gate signal generator 94. The switch 92 transmits an AC voltage $v_s$, received via an inductor L, to one side 102 of the heat source 100, in response to a gate signal 96. To achieve this, the switch 92 may be made up of a gate connected to the gate signal 96 and a triac Ta, which connects the AC voltage $v_s$ (connected with the inductor L) to the side 102 of the heat source 100, in response to the gate signal 96. For example, when the gate signal 96 is in a high logic level, the triac Ta provides the AC voltage illustrated in FIG. 1A to the heat source 100, in a wave number control way, as illustrated in FIG. 1D. Hence, 50% of the AC voltage $v_s$ can be transmitted to the heat source 100.

In response to the level of the driving control signal, received from the timer 42 via an input port IN3, the gate signal generator 94 determines the level of the gate signal 96, when the AC voltage $v_s$ is in a zero level, and outputs the gate signal 96 in the determined level to the switch 92. To achieve this, the gate signal generator 94 can be implemented as a zero crossing phototriac, which includes a light emitting diode PTa2 and a light receiving diode PTa1. The light emitting diode PTa2 receives a predetermined voltage, e.g., 24V, via an input port IN4, and emits light when the driving control signal, e.g., in a high logic level, is received, in response to the driving control signal received from the timer 42 via the input port IN3. The light receiving diode PTa1 receives light emitted from the light emitting diode PTa2 and generates a gate signal 96, in a high logic level, when the AC voltage $v_s$ is in a zero level, during reception of light. On the other hand, if the light receiving diode PTa1 receives no light from the light emitting diode PTa2, that is, if a driving control signal, in a low logic level, is generated, the light receiving diode PTa1 generates a gate signal 96 in a low logic level, when the AC voltage $v_s$ is in a zero level.

The light emitting diode PTa2 may stop emitting light in response to the first control signal C1, received from the sensing signal generator 90 via the input port IN3. For example, the light emitting diode PTa2 can stop the light emission in response to the first control signal C1, which is generated by the sensing signal generator 40, when the measured heat source temperature is lower than the reference temperature and received via the input port IN3. Hence, when the light emission made by the light emitting diode PTa2 is stopped, the AC voltage $v_s$ is not supplied to the side 102 of the heat source 100.

A resistor R1 and a capacitor C1, which are included in the snubber 90, and the inductor L, are used for noise removal and frequency compensation. The AC voltage $v_s$ is supplied as an output voltage $v_{out}$ to a power supply (not shown). The power supply processes the output voltage $v_{out}$ to produce various types of voltage required by a printer. The power supply also produces the predetermined voltage that the light emitting diode PTa2 receives via the input port IN4.

In the heat source controlling method and apparatus, according to embodiments of the present invention, the heat source 100 is driven after the lapse of a predetermined period of time from the point in time when the level of the sensing signal changes, in order to prevent the AC voltage $v_s$ from being supplied with an irregular duty cycle, as illustrated in FIGS. 2D, 3D, or 4D. The supply of the AC voltage $v_s$ at an irregular duty cycle occurs when the frequency of an AC voltage changes in frequency, as illustrated in FIG. 2A or 3A, or when the driving control signal is supplied at an irregular duty cycle, as illustrated in FIG. 4B. Hence, the AC voltage $v_s$ can be supplied to the heat source 100 at regular intervals, that is, at a regular duty cycle. Consequently, flickering caused by the irregular supply of an AC voltage can be prevented.

As described above, in the heat source controlling method and apparatus, according to embodiments of the present invention, if the frequency of a received AC voltage is not fixed to a specific frequency, but rather varies, or if the driving control signal is delayed and generated while the AC voltage has a constant frequency, the driving control signal is generated after the lapse of a predetermined period of time, after the level of a sensing signal is transited from a low logic level to a high logic level. Thus, an AC voltage can be supplied to a heat source at a regular duty cycle, thereby stably controlling the heat source and preventing occurrence of flickering.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, having a fusing roller for fusing toner and a heat source for heating the fusing roller, the image forming apparatus comprising:

a sensing signal generator to change a level of a sensing signal and output the sensing signal with the changed level if a temperature of the heat source is lower than a reference temperature and a level of an input AC voltage is greater than a reference level;

a timer to determine whether a predetermined period of time has lapsed from a moment when the sensing signal level has been changed, and output a driving control signal generated in response to a result of the timer determination; and a heat source driver to drive the heat source when the level of the input AC voltage is a zero crossing level, in response to the driving control signal.

2. The image forming apparatus of claim 1, wherein the sensing signal consists of a high level and a low level.

3. The image forming apparatus of claim 1, wherein the sensing signal generator comprises:

a level measurer to measure the level of the AC voltage;

a temperature sensor to measure the temperature of the heat source;

a temperature comparator to compare the measured temperature of the heat source with the reference temperature and output the result of the comparison as a first control signal;

a voltage comparator to compare the measured level of the AC voltage with the reference level in response to the first control signal and output the result of the comparison as a second control signal; and a level changer to change the level of the sensing signal and output the sensing signal with the changed level, in response to the second control signal.

4. The image forming apparatus of claim 3, wherein the heat source driver stops the driving of the heat source when the level of the input AC voltage is a zero crossing level, in response to the first control signal.

5. The image forming apparatus of claim 3, wherein the sensing signal generator further comprises an analog-to-digital converter to convert the temperature of the heat source measured by the temperature sensor into a digital value and output the measured digital temperature to the temperature comparator, with the temperature comparator comparing the measured digital temperature of the heat source with a digital reference temperature.

6. The image forming apparatus of claim 1, wherein the heat source driver comprises:

a switch to transmit the input AC voltage to the heat source in response to a gate signal; and a gate signal generator to determine a level of the gate signal based on a level of the driving control signal every time the level of the input AC voltage is a zero crossing level, and to output a gate signal with the determined level to the switch, wherein the heat source is driven by the input AC voltage received via the switch.

7. The image forming apparatus of claim 6, wherein the switch comprises a gate connected the gate signal and a triac, and the gate signal generator comprises a phototriac, including a light emitting diode and a light receiving diode, such that the light emitting diode receives a predetermined voltage and emits light based on a level of the driving control signal and the light receiving diode receives light emitted from the light emitting diode and generates the gate signal based on the received light.

8. The image forming apparatus of claim 1, wherein the predetermined period of time is based on at least one of a variation range of the input AC voltage and a delay duration, with the delay duration being a time during which generation of the driving control signal is delayed until the heat source driver receives the driving control signal after the driving control signal is generated in response to the result of the timer determination.

* * * * *

UNITED STATES PATENT AND TRADEMARK OFFICE

CERTIFICATE OF CORRECTION

PATENT NO. : 7,012,222 B2
APPLICATION NO. : 10/885111
DATED : March 14, 2006
INVENTOR(S) : Jong-yang Choo It is certified that error appears in the above-identified patent and that said Letters Patent is hereby corrected as shown below:

Col. 12, Line 22, after "connected" insert --to--.

Signed and Sealed this

Thirty-first Day of October, 2006

JON W. DUDAS
*Director of the United States Patent and Trademark Office*